US005927371A

United States Patent [19]

Schofield et al.

[11] Patent Number: 5,927,371

[45] Date of Patent: Jul. 27, 1999

[54] MODULAR MATERIAL HANGING ASSEMBLY

[75] Inventors: Ellen S. Schofield, Rockville; Deena Yaver, Silver Spring, both of Md.

[73] Assignee: Ellen U. Schofield, Rockville, Md.

[21] Appl. No.: 08/912,060

[22] Filed: Aug. 15, 1997

Related U.S. Application Data

[60] Provisional application No. 60/024,104, Aug. 16, 1996.

[51] Int. Cl.[6] ..... A47H 13/14

[52] U.S. Cl. ..... 160/348; 160/349.2; 248/262; 248/265; 248/201

[58] Field of Search ..... 160/348, 349.1, 160/349.2, 330, 38, 39; 248/261, 262, 265, 201, 298.1, 291.1; 211/105.3

[56] References Cited

U.S. PATENT DOCUMENTS

| | | | |
|---|---|---|---|
| 786,468 | 4/1905 | Spencer | 160/349.2 |
| 1,139,451 | 5/1915 | Walker | 248/261 X |
| 1,524,977 | 2/1925 | King | 160/349.2 X |
| 1,528,910 | 3/1925 | Carlson | 248/265 X |
| 1,817,962 | 8/1931 | Breuer | 160/349.2 X |
| 1,836,018 | 12/1931 | Dover | 160/349.2 X |
| 1,933,994 | 11/1933 | Mott et al. | 160/349.2 X |
| 2,190,764 | 2/1940 | Arnold | 160/349.2 |
| 2,251,512 | 8/1941 | Bush et al. | 160/349.2 X |
| 2,269,738 | 1/1942 | Rybicky | 248/265 |
| 2,364,275 | 12/1944 | Davis | 248/261 X |
| 2,534,491 | 12/1950 | Wersching | 160/348 |
| 2,796,925 | 6/1957 | Woodward | 160/349.2 X |
| 2,964,277 | 12/1960 | Sonntag | 248/265 X |
| 3,399,711 | 9/1968 | Stulac et al. . | |
| 5,184,661 | 2/1993 | Hannerstig . | |
| 5,240,059 | 8/1993 | White | 160/349.2 |
| 5,316,067 | 5/1994 | LeClaire . | |
| 5,343,925 | 9/1994 | Hannerstig . | |
| 5,428,867 | 7/1995 | Hannerstig . | |
| 5,544,692 | 8/1996 | McMichael . | |

*Primary Examiner*—David M. Purol

*Attorney, Agent, or Firm*—Sixbey, Friedman, Leedom & Ferguson; Charles M. Leedom, Jr.

[57] ABSTRACT

A modular material hanging assembly is provided for adjustably hanging pieces of material, such as swags, to form a plurality of arcuate folds of varying radii in the material. The material is hung by material holding brackets consisting of a main assembly with a J-shaped member vertically attached to a wall and an L-shaped adjustable arm attached to a first extension member such that a tie member with material gathered on it can be attached to securements on each member to form the arcuate folds of varying radii in the material. Further, an auxiliary bracket, consisting of an L-shaped member vertically attached to the wall with a telescoping extension member, can be attached to the material holding bracket so that a cascade can be draped over the auxiliary bracket.

19 Claims, 9 Drawing Sheets

MODULAR MATERIAL HANGING ASSEMBLY

RELATED APPLICATION

This application claims the benefit of U.S. Provisional Application No. 60/024,104, filed Aug. 16, 1996.

TECHNICAL FIELD

The present invention relates generally to material hanging assemblies, and more particularly to modular decorative material hanging assemblies which provide for a custom look and adjustability.

BACKGROUND ART

Present day decorative material hanging assemblies often include the use of a curtain rod and pre-fabricated material, such as swags or cascades. These assemblies often require a cumbersome amount of hardware that has limited versatility because it cannot be adapted to fit into varying spaces (such as different sized windows), because of varying pre-fabricated material designs, and because the hang of the material cannot be adjusted, or cannot be easily adjusted, by the assembly. U.S. Pat. No. 3,399,711 to Stulac et al. discloses a decorative material hanging assembly of this type using a curtain rod and pre-fabricated swags and cascades which allows for limited horizontal adjustment along the curtain rod, but does not allow for vertical adjustment without movement of the curtain rod.

In an attempt to overcome these disadvantages, decorative material hanging assemblies have been designed utilizing modular units in place of a curtain rod to support the material. U.S. Pat. No. 5,316,067 to LeClaire discloses a swag support system of this type. However, these assemblies require precise or intricate placement of material, making them hard for an unexperienced user to assemble and they do not allow for adjustment once the material is placed in the assembly.

In a further attempt to overcome these disadvantages decorative material hanging assemblies have been designed with limited means for adjustment of the hang of the material. U.S. Pat. No. 5,544,692 to McMichael discloses a curtain draping system including a curtain rod and curtain holders attached to the curtain rod which allow for limited horizontal adjustments by detaching the clips from the rod and moving them to a different location on the rod. However, no means for vertical adjustment is provided.

Additionally, other decorative material hanging assemblies have been designed to include brackets which create arcuate folds in material. For example U.S. Pat. Nos. 5,184,661, 5,343,925, and 5,428,867 all to Hannerstig disclose stationary members with one or more loops, hooks, or other holding means to hold material to form arcuate folds in the material. However, these members do not overcome the disadvantages of the other prior art.

SUMMARY OF THE INVENTION

It is a primary object of this invention to provide a material holding and mounting system that overcomes the deficiencies of the prior art, and in particular, improves the simplicity, ease-of-use, appearance, flexibility, durability, and adjustability of previously known material holding systems.

It is another object of the present invention to provide a modular material hanging assembly that allows for simultaneous adjustment in the radii of curvature of multiple arcuate folds formed in the material.

It is another object of the present invention to provide a modular material hanging assembly which can be used to span different widths depending on the needs of a user.

It is another object of the present invention is to provide a modular material hanging assembly that can be installed by an inexperienced user, but that provides a custom look for the user.

It is another object of the present invention is to provide a modular material hanging assembly that can easily be removed after it is set up and moved to another desired location.

It is another object of the present invention to provide a modular material hanging assembly which allows for adjustment of a series of arcuate folds in the material without removal from the assembly.

It is another object of the present invention to provide a modular material hanging assembly that allows for adjustability based on simple rotation of an adjustable arm.

It is another object of the present invention to provide a modular material hanging assembly that allows for pleated or gathered swags, and for swags to overlap or abut together with jabots or other decorative pieces of material between the swags.

It is another object of the present invention to provide a modular material hanging assembly that has auxiliary securements for permitting one end of a swag to be mounted adjacent the upper edge of another swag in a manner to completely cover the material holding bracket.

It is another object of the present invention to provide a modular material hanging assembly that has auxiliary brackets for mounting cascades to widen the assembly and hide the material hanging bracket and the auxiliary bracket from view.

These and other objects of the present invention are attained by providing a modular material hanging assembly that is adaptable to span different widths based on the needs of the user. A plurality of such material holding brackets may be placed at locations corresponding to locations where the ends of swags are desired to be hung either singularly or in patterns of multiple swags. The material holding bracket consists of a J-shaped member that vertically attaches to a surface and an L-shaped adjustable arm that rotatably attaches to a main extension member such that a tie member with material gathered on it can be attached to securements on each member to hang one end of the swag. An auxiliary bracket can be placed adjacent to the first and last material holding brackets to form a complete material hanging assembly. The auxiliary bracket consisting of an L-shaped member vertically attached to the surface with a telescoping member, slidably attached to the L-shaped member, having a hooked end for attaching to a securement of the main assembly so that material can be draped over the extendable link to hide the brackets from view and widen the decorative material hanging assembly. The hang of the swags and the radii of curvature of the swag folds can be adjusted by rotating the adjustable arm to a higher or lower position. Further, once hung the radii of curvature of the swag folds created by gathering the material in the tie member can be easily adjusted by hand without removal from the brackets.

DESCRIPTION OF THE PREFERRED EMBODIMENTS

Figure 1:
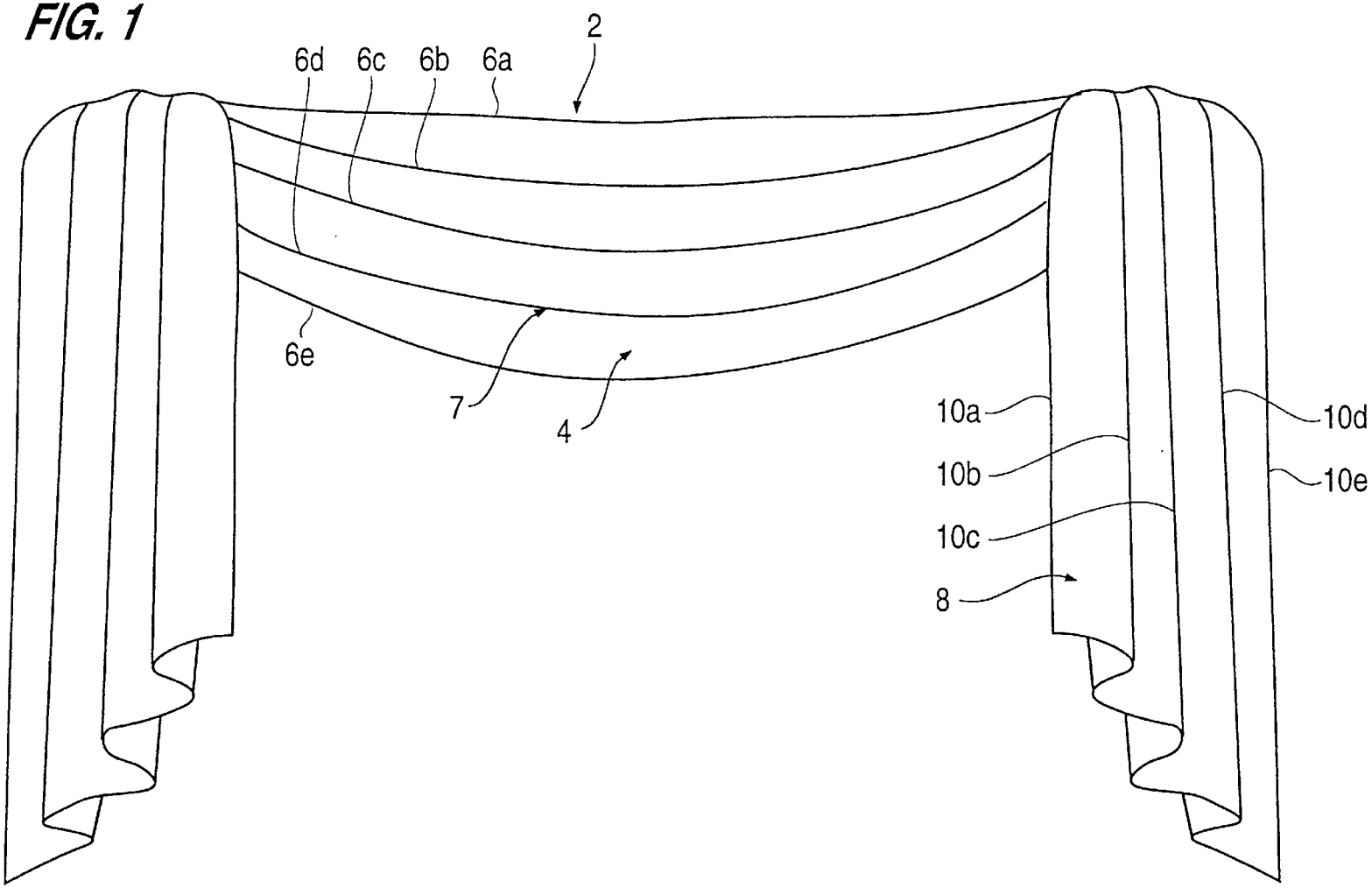
FIG. 1 is a front elevation view of a finished modular material hanging assembly designed in accordance with the subject invention.

Referring now to FIG. 1, the modular material hanging assembly indicated generally at 2 includes one or more swags 4 containing a plurality of arcuate folds 6*a–e* having varying radii of curvature. For example, fold 6*e* has a smaller radius of curvature than 6*b*. A separate vertically hung piece of material, such as a cascade 8, may be hung at each end of the modular material hanging assembly 2 containing a plurality of generally vertical folds 10*a–e*.

Figure 2:
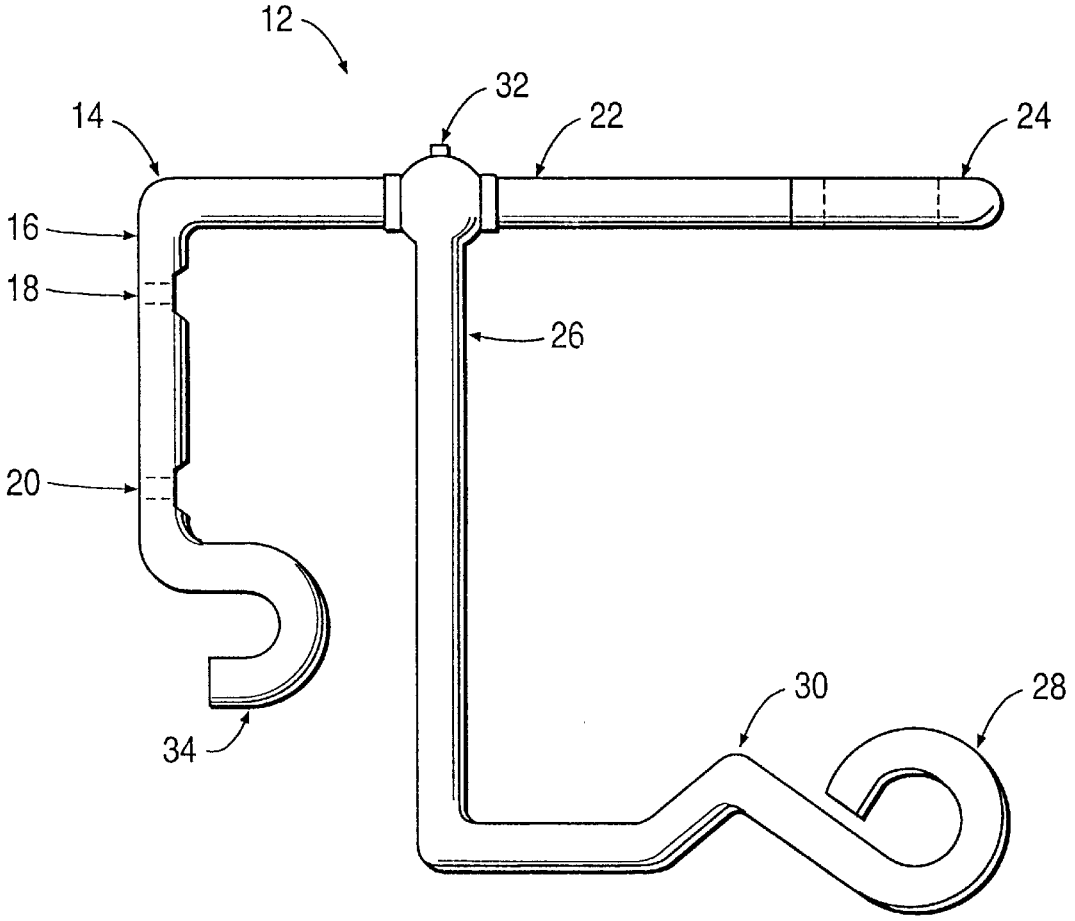
FIG. 2 is a side elevational view of a material holding bracket employed to support each end of the material illustrated in FIG. 1.
Figure 3:
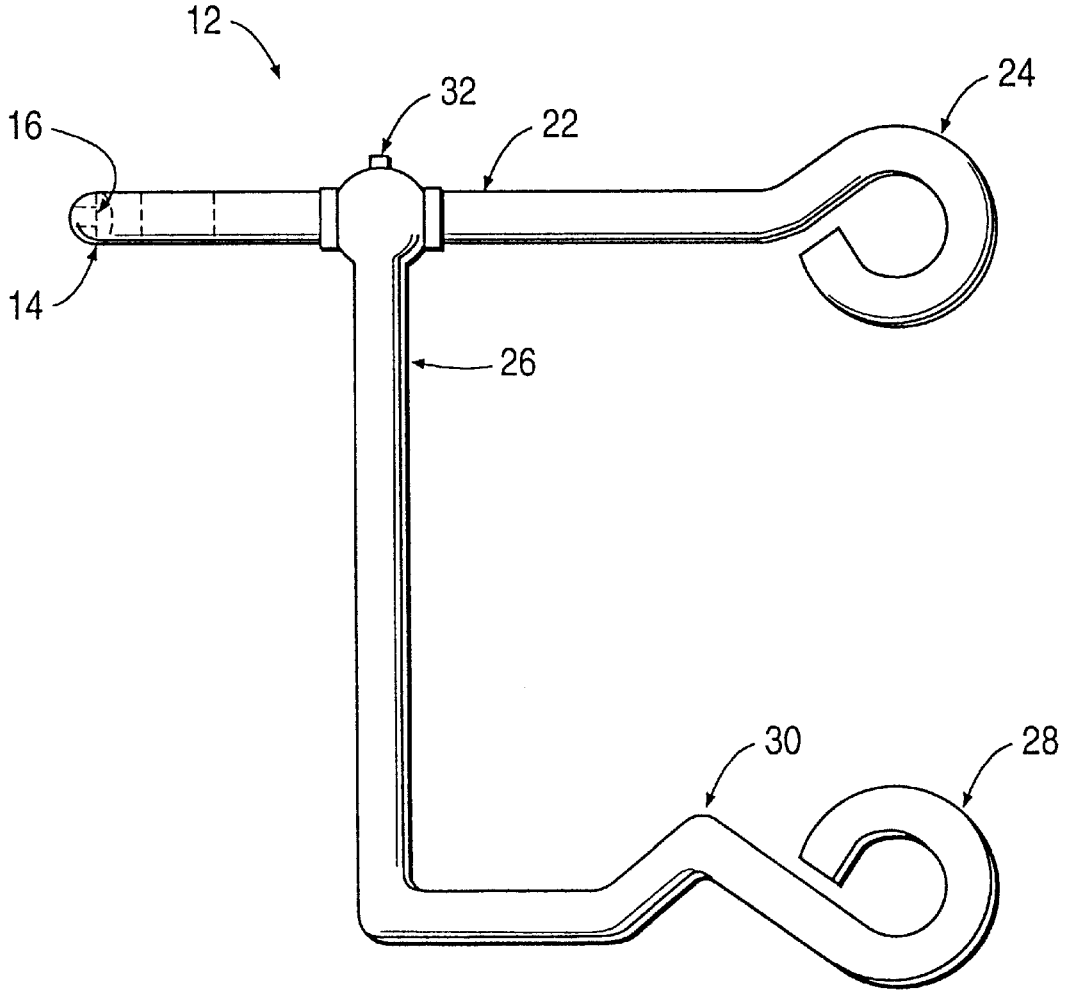
FIG. 3 is a top elevational view of a material holding bracket illustrated in FIG. 2 with an adjustable arm being rotated to its horizontal position.

Turning now to FIGS. 2 and 3, a material holding bracket indicated generally at 12 consists of a J-shaped member 14 having a first surface engaging base 16 adapted for attaching to a surface with openings 18 and 20 for accepting screws or other types of fasteners, not illustrated, for attaching the material holding bracket to a surface such as a building wall or the woodwork surrounding a window or door of the building. The material holding bracket also includes a first extending member 22 and an adjustable arm 26 rotatably connected to the first extending member 22 each having a securement 24 and 28, respectively, such as a loop, an eyelet, clips, or other suitable securement, at an end furthest from the first surface engaging base 16 for securing of a tie member and for adjustment of the plurality of arcuate folds 6*a–e* having varying radii of curvature by rotation of the adjustable arm 26. The adjustable arm 26 also contains an auxiliary securement 30, such as a bend in the adjustable arm 26 or other suitable securement not shown, adjacent to the securement 28 for permitting one end of material to be mounted adjacent the upper edge of another piece of material as described hereinafter. A set screw 32 is positioned at the connection of the adjustable arm 26 and the first extending member 18 for fixing the position of the adjustable arm 26 at a desired location and thereby fixing the multiple arcuate folds 6*a–e* having varying radii of curvature in a desired position. Additionally, the first surface engaging base 16 has a hooking means 34 at its bottom portion for attaching a cascade 8 as described herein below.

Figure 4:
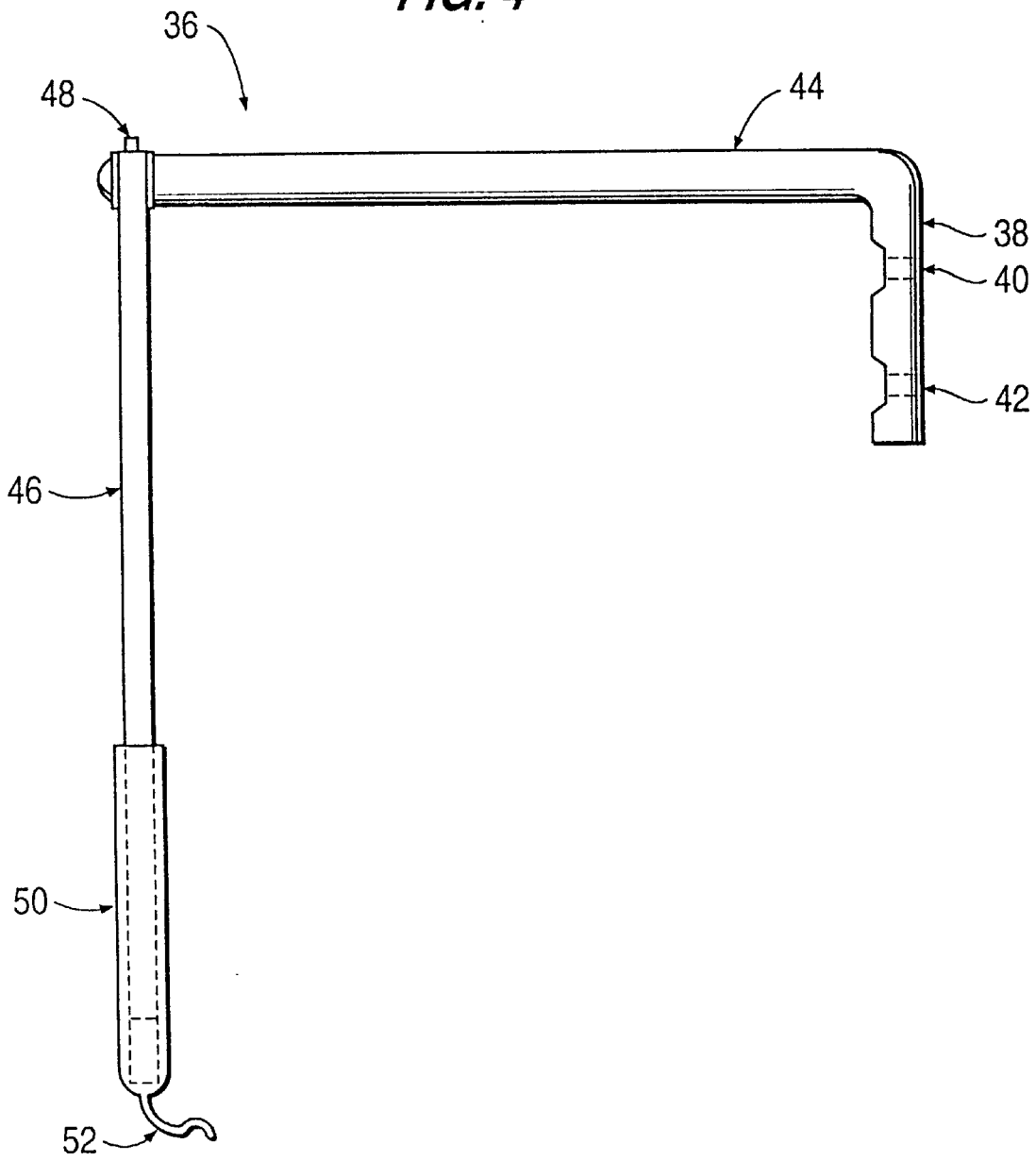
FIG. 4 is a side elevational view of an auxiliary bracket as employed in the assembly illustrated in FIG. 1.

Turning now to FIG. 4, an auxiliary bracket indicated generally at 36 consists of a second surface engaging base 38 with openings for screws 40 and 42 or other types of fasteners, not illustrated, for attaching the auxiliary bracket to a surface such as a building wall or the woodwork surrounding a window or door of the building. The auxiliary bracket also includes a second member 46 rotatably attached to the end of a first member 44 and provided with a set means 48 so that a hollow, telescoping extension 50 slidably received on the second member 46 can be connected by a hook 52 to the securement 24 for hanging a cascade 8 as described herein below.

Figure 5:
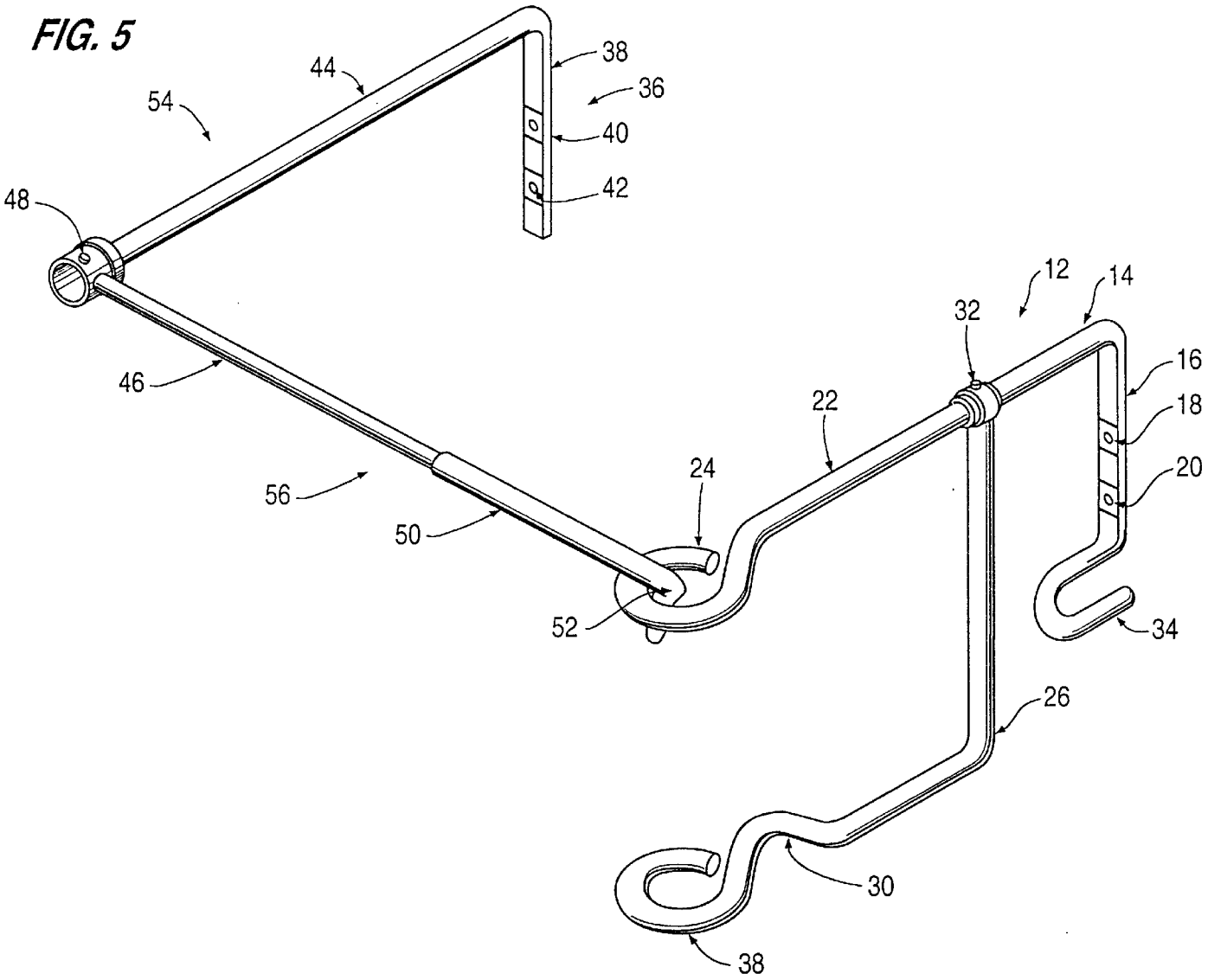
FIG. 5 is a perspective view of a material holding bracket and an auxiliary bracket mounted for cooperative engagement employed to support a cascade as illustrated in FIG. 1.

Turning now to FIG. 5, the connection of the material holding bracket 12 and the auxiliary bracket 36 is shown generally at 54. The connection 54 is made by the hook 52 on the end of the telescoping extension 50 which is positioned to attach to the securement 24, thus forming a support 56 for draping a cascade 8 over, thereby extending the width of the modular material hanging assembly 2 and hiding the material handling bracket 12 and the auxiliary bracket 36 from view.

Figure 6:
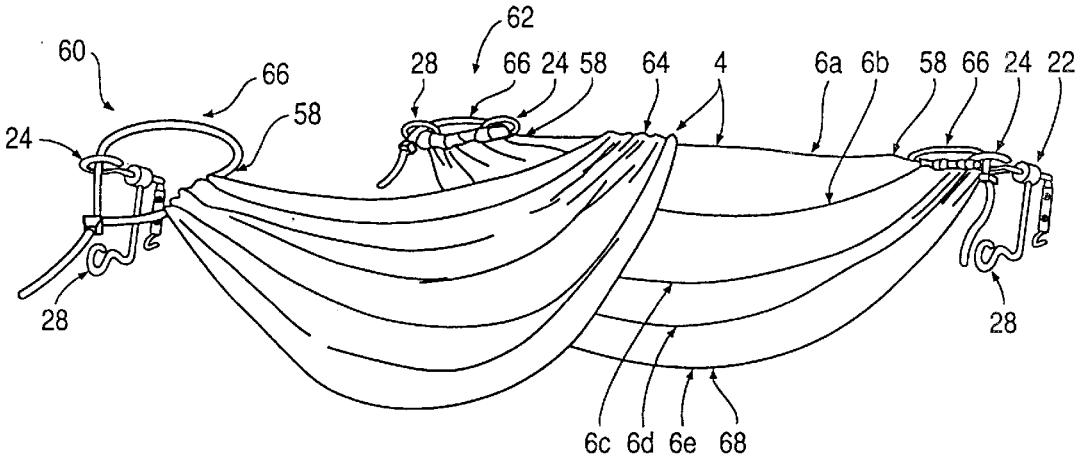
FIG. 6 is a front elevated view of a two swag system wherein the vertically hanging material at one end has been disposed to demonstrate how the material holding bracket may be used.

Turning now to FIG. 6, a multiple swag arrangement is illustrated without auxiliary brackets 36 for purposes of showing methods of hanging material from the material holding brackets 12. In a multiple swag system, auxiliary brackets 36 are generally required to allow for proper hang of the last swag 4 at the end of the set of multiple swags, to allow for support of both cascades 8 and to allow for additional width expansion in the modular material hanging assembly 2. When making a modular material hanging assembly 2 a plurality of material holding brackets are placed at a plurality of spaced apart locations corresponding to desired locations of ends of swags 58. A swag 4 is attached at an end 58 to the material holding bracket 12 by either the method indicated generally at 60, the method indicated generally at 62, or the method indicated generally at 64. In the method indicated at 60 a tie member 66 is inserted in the end of the swag 58 and the tie member 66 is inserted through securement 24 and tightened to secure the swag 4 in position. Additionally, in the method indicated generally at 60, a cascade 8 (not illustrated) can be attached to the securement 28 of the adjustable arm 26. In the method indicated at 62 a tie member 66 is similarly inserted in the end of the swag 58, then the tie member 66 is inserted through both securement 24 and securement 28 and tightened to secure the swag 4 into position. In this embodiment the hang 68 of the swag 4 can be adjusted by raising or lowering the adjustable arm 26, thereby also adjusting the plurality of multiple arcuate folds 6*a–e* having varying radii of curvature. Further, in any method of hanging a tie member may be equipped with spacing members, such as beads, clips or other suitable spacing members, to be placed between pleats of pleated material to maintain the pleats in a proper decorative position as the system is adjusted such as by rotation of the adjustable arm 26.

Figure 7:
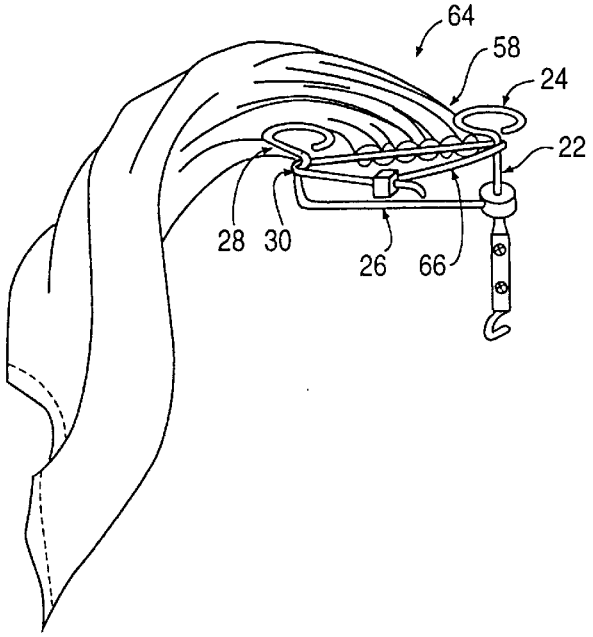
FIG. 7 is a front elevated view of a swag connected to a material holding bracket for hanging over another swag as illustrated in FIG. 6 wherein the material has been disposed to demonstrate the method of securing the material to the material holding bracket.

In a multiple swag arrangement when a swag is to be hung partially covering another as shown generally at 64 a third method is used, illustrated in FIG. 7. In this method a tie member 66 is inserted in the end of the swag 58 and is secured around the first extending member 22 adjacent the securement 24 and around the auxiliary securement 30 in the adjustable arm 26, thereby covering the securements 24 and 28 from view. This method of hanging 64 also allows for adjustment of the hang 68 of the swag 4 and corresponding adjustment of the plurality of arcuate folds 6 having varying radii of curvature by rotating the adjustable arm 26 upon which the opposite end of the swag is mounted, as in method of hanging 62, described above. Alternatively, the swag 4 being overlapped by the method of hanging shown generally at 64 (FIG. 6) may be mounted on the securements 24 and 28 of the same material hanging bracket 12 used to hang the overlapping swag 4, as shown generally at 62, instead of on a separate material holding bracket, as shown in FIG. 6. In a further alternative, a swag 4 may be hung on the second securement 28 as shown generally at 60 and the overlapping swag 4 may then be hung from the first securement 24 of the same material holding bracket 12, thereby reducing the width of the modular material hanging assembly 2. In a still further alternative, a tie member 66 may be inserted in two swags and secured through securements 24 and 28 such that the swag to be overlapped is positioned on the portion of the tie member 66 shown beneath the securements 24 and 28 and the overlapping swag is positioned on the portion of the tie member 66 shown above the securements 24 and 28.

In another alternative, a first swag 4 may be hung from the first and second securements 24 and 28 as shown generally at 64 (FIG. 6) and a second swag may be hung by inserting a second tie member through the second swag and securing the second tie member around the auxiliary securement 30 and the first extending member 22 as shown generally at 64 (FIG. 7), except that the swag 4 would hang as shown beneath the securements 24 and 28 instead of as shown above at 64. In such a configuration an appropriate cover, such as a jabot or other decorative material, would normally be used to cover the material hanging bracket 12.

Figure 8:
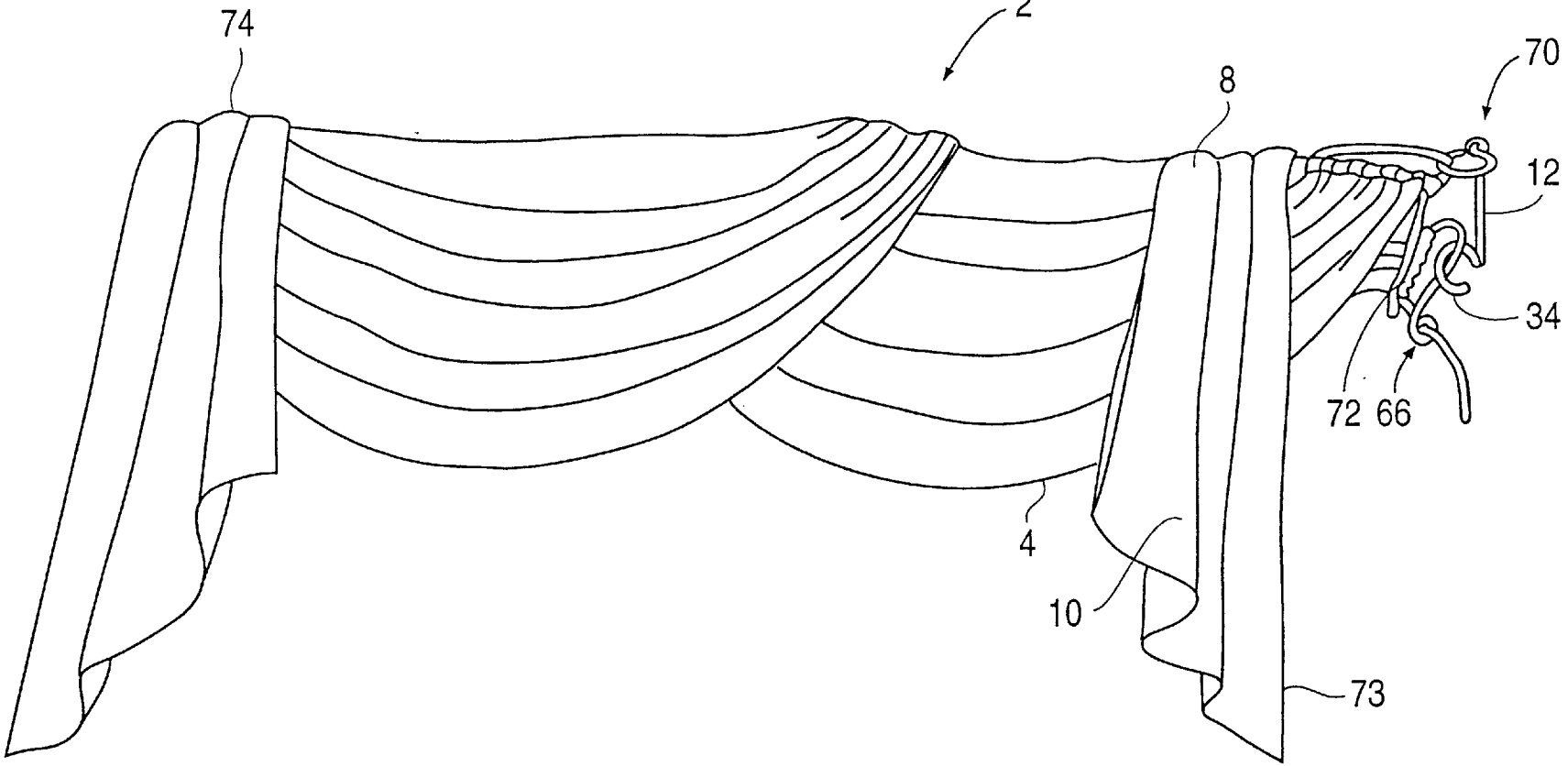
FIG. 8 is a front elevated view of a two swag system as illustrated in FIG. 6 wherein one cascade has been moved to show how the cascade may be connected to the material holding bracket.

Turning now to FIG. 8, a method of hanging a cascade 8 at the ends of a modular material hanging assembly 2 is shown generally at 70 wherein a tie member 66 is inserted in the top end of a cascade 72 and is secured around the hooking means 34 behind the swag 4 with the bottom portion of the cascade 73 draped over the material holding bracket 12 thereby creating a plurality of folds 10 and covering the material holding bracket 12 from view shown generally at 74.

Figure 9:
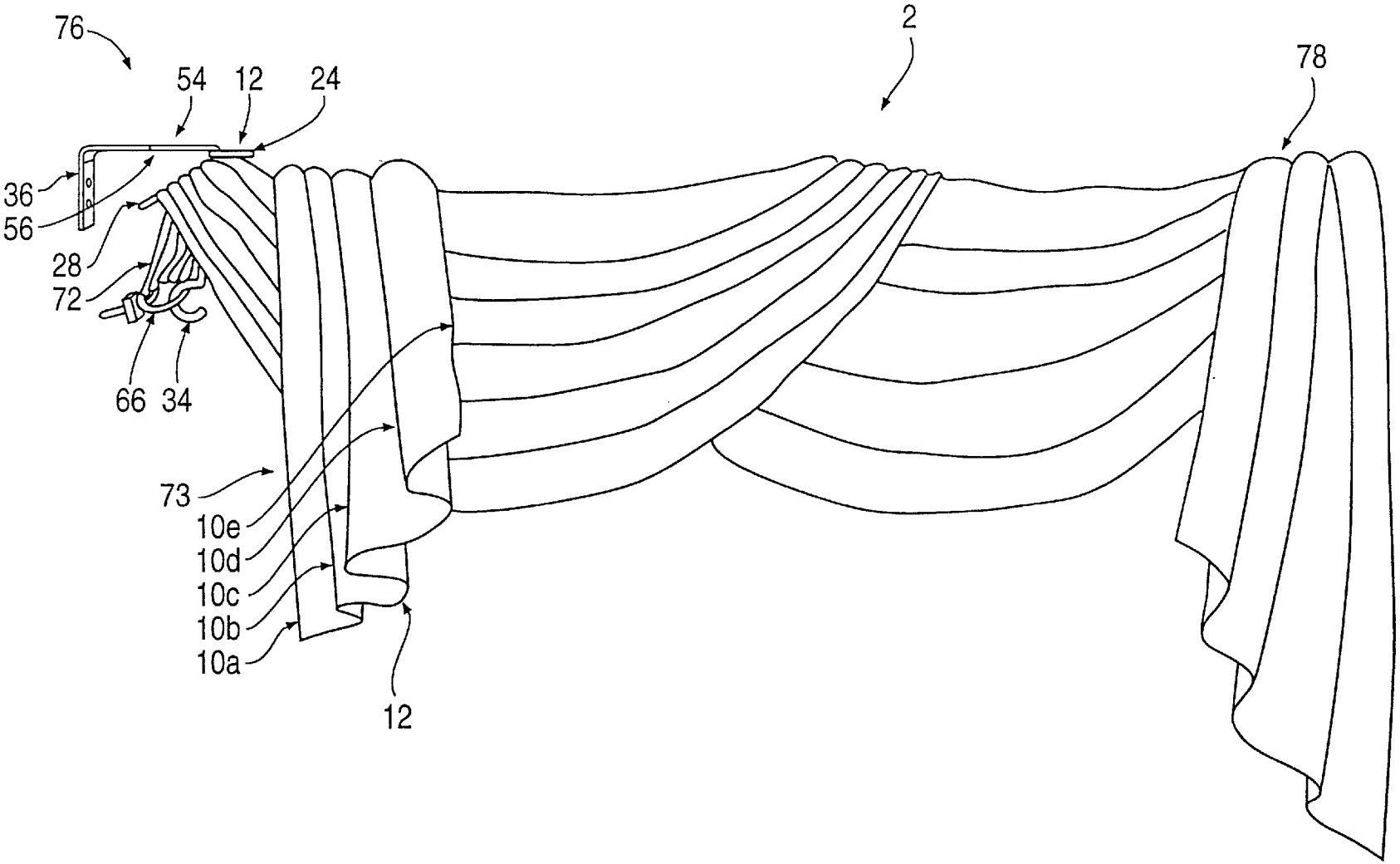
FIG. 9 is a front elevated view of a two swag system as illustrated in FIG. 8 with the addition of auxiliary brackets connected to the material holding bracket and with the cascade disposed to demonstrate how the material holding bracket and auxiliary bracket may be used.

Turning now to FIG. 9, a method of hanging a cascade 8 at the ends of a modular material hanging assembly 2 with an auxiliary bracket 36 for increasing the overall width of the modular material hanging assembly 2 is shown generally at 76. The auxiliary bracket 36 is attached to the securement 24 of the material holding bracket 12 as shown generally in FIG. 5 at 54 and described above. A tie member 66 is inserted in the top end of a cascade 72 and is secured around the hooking means 34, shown out of plane, behind the swag 4 with the bottom portion of the cascade 73 draped over the support 56 thereby creating a plurality of generally vertical folds 10 and covering the material bracket 12 and the auxiliary bracket 36 while increasing the overall width of the modular material hanging assembly. 2, as shown generally at 78.

Figure 10:
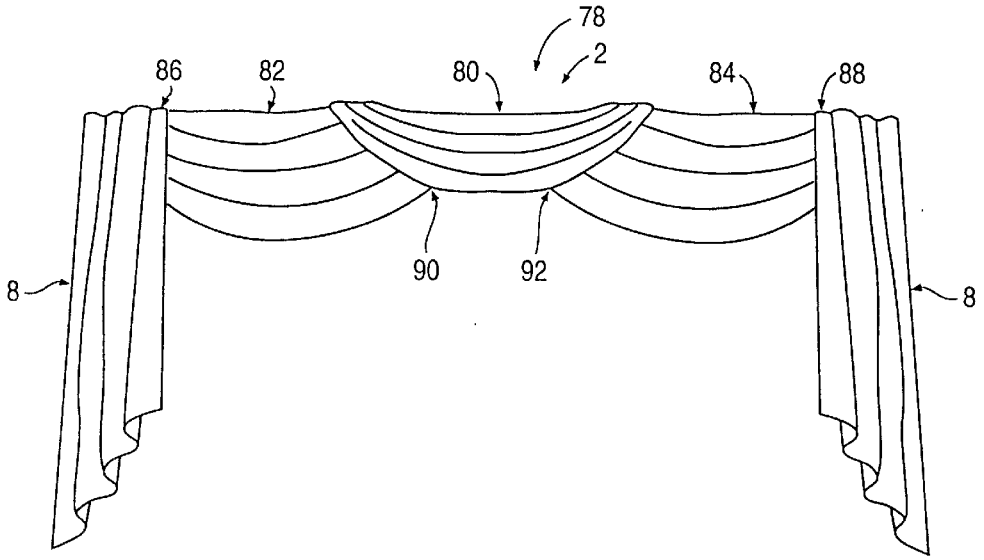
FIG. 10 is a front elevation view of a finished modular material hanging assembly having three swags designed in accordance with subject invention.

Turning now to FIG. 10, a modular material hanging assembly 2 with an embodiment for a three swag system is shown generally at 78, wherein a middle swag 80 has a hang smaller than that of the end swags 82 and 84, respectively thereby providing a general sloping effect to the modular material hanging assembly 2. In the three swag system 78 the middle swag 80 is hung by the method shown generally at 64 in FIGS. 6 and 7 and described above, and the cascades 8 are hung by either method 70 shown in FIG. 8 or by method 76 shown in FIG. 9, both described above. Additionally, the ends of the end swags 82 and 84 at the ends of the modular material hanging assembly 86 and 88, respectively can be hung either using method 62 or 64 as shown in FIG. 6 and described above.

Figure 11:
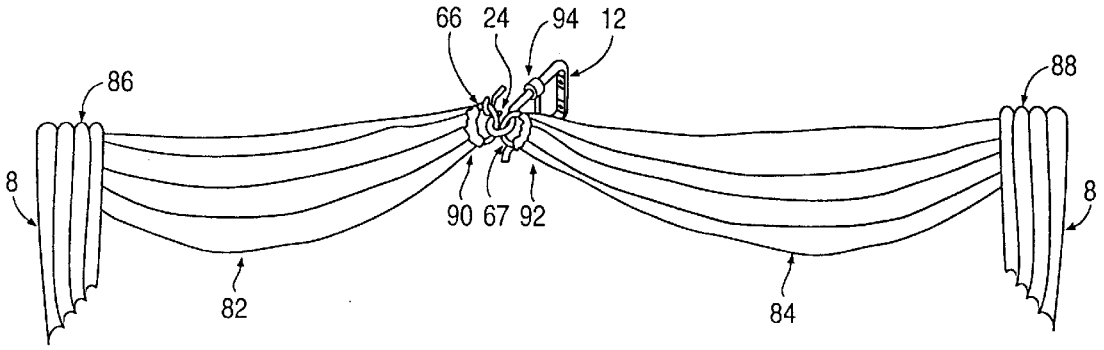
FIG. 11 is a front elevated view of a three swag system as illustrated in FIG. 10 wherein the center material has been removed to demonstrate how the material holding bracket may be used.

The center ends of the end swags 82 and 84, 90 and 92, respectively, can be hung using a method to bring them closer together as shown generally at 94, illustrated in FIG. 11. In the method 94 tie members 66 and 67 are inserted into each center end 90 and 92, respectively, and the tie members 66 and 67 are both inserted through securement 24 and tightened thereby hanging the center ends 90 and 92 close to each other to aid in the effect of the three swag embodiment 78. Additionally, each center end of the swag 90 and 92 may be hung on a securement 24 and 28, respectively, thereby widening the coverage of the modular material hanging assembly 2. In such a configuration the middle swag 80 would normally be used to cover the material hanging assembly 12, however, any appropriate cover, such as a jabot or other decorative material, could be used in place of the middle swag 80.

INDUSTRIAL APPLICABILITY

The modular material hanging assembly 2 serves as a custom looking assembly that can be installed by an unskilled user which is readily adjustable to meet the needs of the user through the use of rotating adjustable arms 26. Additionally, through the use of auxiliary brackets 36 and movement of the material holding brackets 12 the modular material hanging assembly 2 can be altered to fit any width required by the user.

We claim:

1. A material holding bracket for holding material adjacent a surface to form multiple arcuate folds having varying radii of curvature and for allowing adjustment in radii of curvature of the multiple arcuate folds, comprising:

a first surface engaging base adapted to be mounted on the surface; attaching means connected with said first surface engaging base for supporting one portion of the material to allow the radii of curvature of the multiple folds to be simultaneously modified whenever said attaching means is rotationally adjusted relative to said first surface engaging base, wherein said attaching means includes a first extension member connected to said first surface engaging base, an adjustable arm rotationally connected to said first extension member for attaching the material so that the radii of curvature of the multiple arcuate folds can be adjusted by rotating said adjustable arm, and first and second securements formed, respectively, adjacent the ends of said first extension member and said adjustable arm, said second securement moving in an arc about said first securement as said adjustable arm is rotated to define a plane that is generally parallel with the surface on which said first surface engaging base is adapted to be mounted; and a tie member engaging said first and second securements which forms a material anchor to secure the material to form the multiple arcuate folds;

wherein said first surface engaging base and said first extension member form, respectively, the legs of a first L-shaped element formed from a continuous metal wire and said adjustable arm is formed by a second L-shaped element formed from a continuous metal wire.

2. A material holding bracket for holding material adjacent a surface to form multiple arcuate folds having varying radii of curvature and for allowing adjustment in radii of curvature of the multiple arcuate folds, comprising:

a first surface engaging base adapted to be mounted on the surface;

attaching means connected with said first surface engaging base for supporting one portion of the material to allow the radii of curvature of the multiple arcuate folds to be simultaneously modified whenever said attaching means is rotationally adjusted relative to said first surface engaging base, wherein said attaching means includes a first extension member connected to said first surface engaging base, and an adjustable arm rotationally connected to said first extension member for attaching the material so that the radii of curvature of the arcuate of the folds can be adjusted by rotating said adjustable arm;

a hook means connected to said first surface engaging base for securing a cascade to form folds along multiple paths; and an auxiliary bracket including a second surface engaging base adapted to be mounted on the surface adjacent said material holding bracket, and a bridging means rotatably attached to said second surface engaging base for engaging said first extension member thereby forming a support over which the cascade can be draped to hide said material holding bracket and said auxiliary bracket;

wherein said bridging means further comprises a first member connected to said second surface engaging base, a second member rotatably attached to said first member, and a telescoping member telescopingly attached to said second member having a means for connecting to said first extension member at an end opposite said second member.

3. A material holding bracket for securing material to form multiple arcuate folds having varying radii of curvature extending between a pair of spaced attachment areas of the material and for allowing adjustment in radii of curvature of the multiple arcuate folds, comprising a first base adapted to mount said material holding bracket adjacent to one of the attachment areas, attaching means connected with said first base for securing one portion of the material adjacent to the one attachment area and being pivotally adjustable relative to said first base to allow the radii of curvature of the multiple arcuate folds extending between the pair of spaced attachment areas to be simultaneously modified whenever said attaching means is pivotally adjusted relative to said first base, said attaching means including a first extension member connected to said first base, and an adjustable arm rotationally connected to said first extension member for attaching the material so that the radii of curvature of the multiple arcuate folds can be adjusted by rotating said adjustable arm, said attaching means further including first and second securements formed, respectively, adjacent the ends of said first extension member and said adjustable arm, said second securement moving in an arc about said first securement as said adjustable arm is rotated to define a plane that is generally parallel with a mounting surface of said first base, and a tie member engaging said first and second securements which forms a material anchor to secure the material to form the multiple arcuate folds;

wherein said first base and said first extension member form, respectively, the legs of a first L-shaped element formed from a continuous metal wire and said adjustable arm is formed by a second L-shaped element formed from a continuous metal wire.

4. A material holding bracket for securing material to form multiple arcuate folds having varying radii of curvature extending between a pair of spaced attachment areas of the material and for allowing adjustment in radii of curvature of the multiple arcuate folds, comprising a first base adapted to mount said material holding bracket adjacent to one of the attachment areas, attaching means connected with said first base for securing one portion of the material adjacent to the one attachment area and being pivotally adjustable relative to said first base to allow the radii of curvature of the multiple arcuate folds extending between the pair of spaced attachment areas to be simultaneously modified whenever said attaching means is pivotally adjusted relative to said first base, said attaching means including a first extension member connected to said first base, and an adjustable arm rotationally connected to said first extension member for attaching the material so that the radii of curvature of the multiple arcuate folds can be adjusted by rotating said adjustable arm, an auxiliary bracket including a second base adapted to mount said auxiliary bracket adjacent said material holding bracket, a hook means connected to said first base for securing a cascade to form folds along multiple paths, and a bridging means pivotally attached to said second base for engaging said first extension member thereby forming a support over which the cascade can be draped to hide said material holding bracket and said auxiliary bracket;

wherein said bridging means further comprises a first member connected to said second base, a second member rotatably attached to said first member, and a telescoping member telescopingly attached to said second member having a means for connecting to said first extension member at an end opposite said second member.

5. The material holding bracket as defined in claim 4, wherein said bridging means further includes a means for fixing said second member in a desired position of rotation.

6. A material holding system comprising:

a material extending between at least two spaced attachment areas and forming multiple arcuate folds with varying radii of curvature extending between a pair of said at least two spaced attachment areas;

at least one material holding bracket mounted adjacent to at least one of said pair of attachment areas for securing the respective one of said attachment areas of said material and for allowing adjustment in radii of curvature of said multiple arcuate folds, said material holding bracket including a first base mounting said material holding bracket adjacent to said respective one attachment area, and attaching means connected with said first base and securing said respective one attachment area of said material, said attaching means being pivotally adjustable relative to said first base to allow the radii of curvature of said multiple arcuate folds to be simultaneously modified whenever said attaching means is pivotally adjusted relative to said first base.

7. The material holding system as defined in claim, 6, wherein said attaching means includes a first extension member connected to said first base, and an adjustable arm rotationally connected to said first extension member for attaching said material so that the radii of curvature of said multiple arcuate folds can be adjusted by rotating said adjustable arm.

8. The material holding system as fefined in claim 7, wherein said material holding bracket further includes a hook means connected to said first base for securing a cascade to form folds along multiple paths, and wherein the material holding system further includes an auxiliary bracket including a second base adapted to mount said auxiliary bracket adjacent said material holding bracket, and a bridging means pivotally attached to said second base for engaging said first extension member thereby forming a support over which the cascade can be draped to hide said material holding bracket and said auxiliary bracket.

9. The material holding system as defined in claim 8, wherein said bridging means further comprises a first member connected to said second base, a second member rotatably attached to said first member, and a telescoping member telescopingly attached to said second member having a means for connecting to said first extension member at an end opposite said second member.

10. The material holding system as defined in claim 9, wherein said auxiliary bracket further includes a means for fixing said second member in a desired position of rotation.

11. The material holding system as defined in claim 7, wherein said attaching means further includes first and second securements formed, respectively, adjacent the ends of said first extension member and said adjustable arm, said second securement moving in an arc about said first securement as said adjustable arm is rotated to define a plane that is generally parallel with a mounting surface of said first base.

12. The material holding system as defined in claim 11, further including a tie member engaging said first and second securements which forms a material anchor to secure said material to form said multiple arcuate folds.

13. The material holding system as defined in claim 12, wherein said first base and said first extension member form, respectively, the legs of a first L-shaped element formed from a continuous metal wire and said adjustable arm is formed by a second L-shaped element formed from a continuous metal wire.

14. The material holding system as defined in claim 12, wherein said tie member is formed of flexible material.

15. The material holding system as defined in claim 11, wherein said attaching means further includes an auxiliary securement formed adjacent said second securement on said adjustable arm for providing a separate attachment site.

16. The material holding system as defined in claim 15, further including a tie member engaging said auxiliary securement and said first extension member to form a material anchor to secure said material to form said multiple arcuate folds while allowing said material to hide said material holding bracket from view.

17. The material holding system as defined in claim 16, wherein said tie member is formed of flexible material.

18. The material holding system as defined in claim 7, wherein said adjustable arm includes a means for fixing said adjustable arm in a desired position of rotation, thereby securing said material with said multiple arcuate folds in a desired position.

19. The material holding system as defined in claim 6, wherein the material holding bracket further includes a hook means connected to said first base for securing a cascade that can be draped over said material holding bracket thereby hiding said material holding bracket from view.

* * * * *